US005295194A

United States Patent [19]

Christensen

[11] Patent Number: 5,295,194

[45] Date of Patent: * Mar. 15, 1994

[54] MULTI-DRIVER LOUDSPEAKER ASSEMBLY

[76] Inventor: Eugene J. Christensen, P.O. Box 4563, Queensbury, N.Y. 12804

[ * ] Notice: The portion of the term of this patent subsequent to Oct. 29, 2008 has been disclaimed.

[21] Appl. No.: 706,965

[22] Filed: May 29, 1991

Related U.S. Application Data

[63] Continuation-in-part of Ser. No. 361,351, Jun. 5, 1989, Pat. No. 5,062,139.

[51] Int. Cl.[5] ..... H04R 25/00

[52] U.S. Cl. ..... 381/192; 381/194; 381/195; 381/196; 381/197

[58] Field of Search ..... 381/192, 182, 185, 192, 381/195, 184, 190, 173; 181/144, 161, 163, 164, 165; 310/324

[56] References Cited

U.S. PATENT DOCUMENTS

| | | | |
|---|---|---|---|
| 2,426,948 | 9/1947 | Preston . | |
| 2,539,672 | 1/1951 | Olson . | |
| 4,386,241 | 5/1983 | Maeda | 381/190 |
| 4,401,857 | 8/1983 | Morikawa | 381/190 |
| 4,475,014 | 10/1984 | King | 381/182 |
| 4,497,981 | 2/1985 | House | 381/190 |
| 4,554,414 | 11/1985 | House | 381/182 |
| 4,845,776 | 7/1989 | Bittencourt | 381/190 |

FOREIGN PATENT DOCUMENTS

| | | | |
|---|---|---|---|
| 0012700 | 7/1982 | Japan . | |
| 0012699 | 1/1984 | Japan | 381/190 |

*Primary Examiner*—Curtis Kuntz
*Assistant Examiner*—Jason Chan
*Attorney, Agent, or Firm*—Schmeiser, Morelle & Watts

[57] ABSTRACT

A multi-driver, coaxially mounted loudspeaker array utilizing a high frequency bi-morph driving element (tweeter) that is preferably contained within the air-core of the voice coil former of a lower frequency loudspeaker (woofer). The outwardly extending conical edge of the high frequency device's diaphragm is annularly fixed by a compliance to the inner surface of the referenced voice coil former or to the woofer diaphragm which extends outwardly therefrom. Alternately, the bi-morph element is attached to other dynamic parts of the woofer such as the dust cap or at the rim of, or otherwise on, an extension of the former. In this mode, the bi-morph element may first be mounted to a section of a cylinder or cone which acts as a frame of the same circumference or more/less than that of the coil former. Thereafter, the frame is mounted to the end of, over or inside the coil former, or any moving part of the woofer.

9 Claims, 8 Drawing Sheets

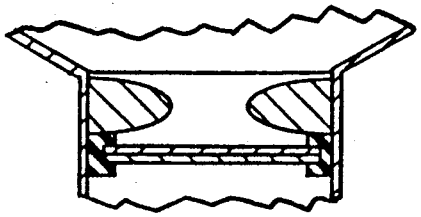
FIG. 7cI
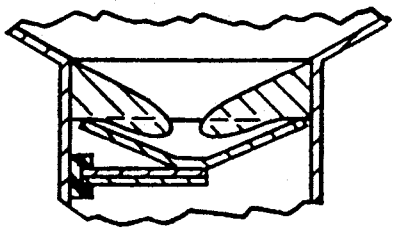
FIG. 7cII
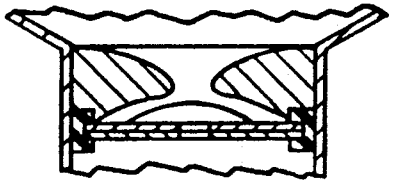
FIG. 7cIII
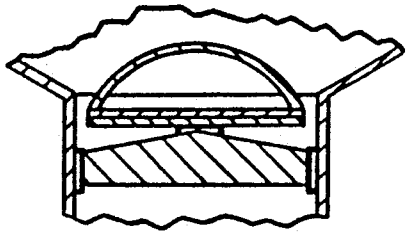
FIG. 7BI
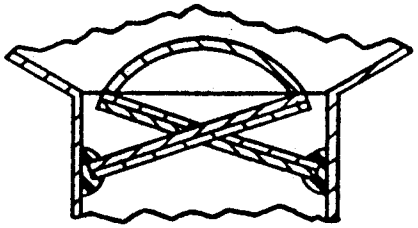
FIG. 7BII
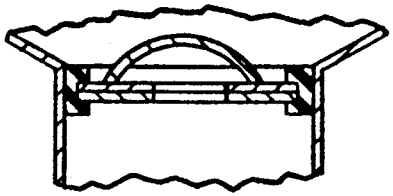
FIG. 7BIII
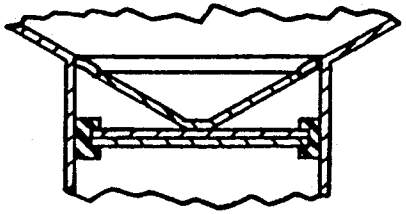
FIG. 7AI
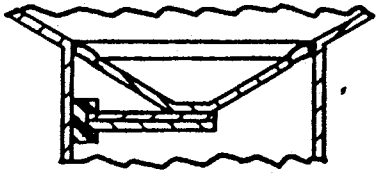
FIG. 7AII
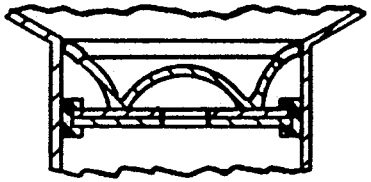
FIG. 7AIII

MULTI-DRIVER LOUDSPEAKER ASSEMBLY

This application is a continuation-in-part of U.S. Ser. No. 361,351 filed on Jun. 5, 1989, now U.S. Pat. No. 5,062,139, hereinafter incorporated by reference.

BACKGROUND OF THE INVENTION

1. Field of the Invention

This invention relates generally to loudspeaker systems and, more particularly, to a sound system in which the audio frequency is divided into upper and lower ranges. The instant invention concerns itself with the particular location of a high-frequency (HF) transducer with respect to certain elements of a low-frequency (LF) transducer, and the particular means for attachment of various elements of the high-frequency transducer to various moving (dynamic) elements of the low-frequency transducer. The collocation of both high-and low-frequency transducers on the same axis is referred to herein as coaxial mounting.

2. Prior Art Discussion

The goal in loud speaker design is to create a device which will accurately transform an electrical signal wave form voltage into an exact replica of the original acoustic pressure wave form which created it. The typical music wave form is a complicated combination of continuous tones, overtones and transient sounds. Also, several instruments or voices are usually superimposed and thus, the total wave form can be thought of as the summation of all the different frequencies which make up the sound as perceived by the listener. The primary characteristics of sound wave forms are phase, amplitude and frequency. The first, phase, refers to the timing relationship of the various frequencies and the transients as they reach the listener's ear. Amplitude is relative size, magnitude or intensity of the various frequencies and transients. Frequency refers to the number of cycles per second of the audio signal, (termed) its pitch. It is possible to identify each instrument or voice of a sound replication by its distinctive combination of overtones and by its location in the stereophonic image. Because of such physiological characteristics as persistence, the human ear is fooled into a "recognition" of the original sound. The ideal speaker device (also referred to herein as a "transducer") is one which is perfectly faithful in phase, amplitude and frequency response—high fidelity, or high "faithfulness".

In the beginning of high fidelity sound replication, the most prevalent form of loud speaker, or electro-audio transducer, was the dynamic radiator speaker. This device essentially comprised a permanent magnet with an air gap and a concentric pole piece on which was mounted a hollow, nonmagnetic, conducting shell known as a former and which was wrapped with an insulated wire termed a voice coil. The former was directly coupled at its outer margin to the apex or minor perimetral margin of a conical paper shell, known as a diaphragm and which projected outward of the permanent magnet assembly. As the voice coil was excited within its permanent magnet environment, the voice coil moved longitudinally and the diaphragm was caused to vibrate, thus replicating the audio (air pressure dynamic) signal that had generated the electrical current passing through the voice coil by pressing dynamically on the contact air mass in front of the diaphragm. The dynamic radiator had several characteristics that were noteworthy, and necessary, to the high fidelity replication of sound at that time: it was relatively efficient; it had a fairly wide frequency range; and it could be used as a low-range, mid-range or high-range electro-audio transducer. Concomitantly, and more so in present context, the dynamic radiator has notable limitations: a single driver cannot cover the entire audible frequency range of 20 hz. to 20 KHZ; multiple drivers (coils) must be used for different parts of the audio spectrum; cross over circuits must be used to separate the audio spectrum; and oftentimes, heavy magnets and rigid support frames are necessary to construct the assembly.

The quest for high fidelity sound reproduction which began in the early 40's, has continued unabated to the present. Of significant relevance to the instant invention is U.S. Pat. No. 2,269,284, issued to Olson in 1942. This patent, referred to in a host of applications since that time, has set the stage for much of the sound reproduction devices relating to high fidelity and stereophonic sound. Olson taught, basically, the coaxial arrangement of multiple speakers, one within the other, and aligned along a central, common core. In the Olson art, the diaphragms of the various loud speakers are generally conically shaped and are arranged in nested, overlapping relationship with their cylindrical driving coils that are arranged concentrically in radially spaced relationship in the air gap formed between the pole pieces of a suitable magnetic structure. The base conical section, or low range speaker (hereinafter referred to as a "woofer") is the first of the loud speakers to be mounted, relative the pole piece. Thereafter, succeedingly smaller conical sections of the relatively smaller loud speakers are nested one within the other, digressing in size to the physically smallest, highest frequency range electro-audio transducer (hereinafter referred to as "tweeter"), with all their diaphragms and respective driving coils forward of the base woofer assembly. Many modifications of the basic invention are referred to in the Olson patent, but it may be generally summarized as a system having the equivalent of large cones and coils for the low audio frequencies, medium size cones and coils for mid-range sound reproduction, and small cones and coils for high-frequency reproduction. The voice coils are generally connected in series with a predetermined capacitance connected across each of the specific coils. With such an arrangement, at low frequencies, a signal flows through all three coils. Concurrently, the reactance and the compliances are small compared to the mass reactance of the several coils; thus, all parts of the system move in (with the same) phase. In the mid-range, very little current appears in the woofer coil because of the effective shunt provided by its capacitance. The mass reactance of the coil is large compared to the compliance; therefore, at such ranges, the diaphragms of both the mid-range and high-range cones are driven by their respective coils. At the high frequencies, the compliance between the tweeter coil and the mid-range coil is small compared to the mass reactance of the mid-range coil, and practically all the current appears in the tweeter coil because of the shunting effected by the woofer and mid-range capacitors, causing the tweeter driver to vibrate its respective cone and produce the desired audio radiation at the higher frequencies. It may be said generally that, since Olson, most of the significant advancements have been made in the placement of the various mid-range and high-range (tweeter) transducers, as well as in the use of different driving mechanisms, such as piezo-electric, electrostatic, magnaplanar, ribbon, plasma, etc. Of the many types of current speaker design (driver mechanisms), the most common and least expensive are the dynamic radiator and piezo-electric. The instant invention contemplates exclusive use of these two types of speaker design.

In 1947, Preston, in U.S. Pat. No. 2,426,948, disclosed a Coaxial Dual-Unit Electrodynamic Loud Speaker in which the tweeter unit was electrically crossed and capacitively coupled to the woofer unit, and coaxially mounted, so that its permanent magnet supporting base resided within the woofer central pole piece. As with the Olson art, however, Preston continued to arrange the driving coils concentrically and in basically the same transverse plane in which the woofer voice coil resided. A compliant member was used to essentially join the tweeter diaphragm to that of the woofer. Compliances are generally used for joining purposes.

In 1985, two patents issued to House, U.S. Pat. No. 4,497,981 and U.S. Pat. No. 4,554,414 for a Multi-Driver Loudspeaker. In the first, '981, a multi-driver loud speaker assembly having high- and low-frequency transducers is realized in which the high frequency transducer is directly coupled to the diaphragm of the low frequency transducer and is movable therewith. In the later patent, '414, a multi-driver loud speaker combination includes a first transducer of the dynamic radiator type (previously discussed), which is designed to reproduce sound in the lower portion of the audio frequency range. The radiator of the first transducer includes a diaphragm and, concentrically aligned and coaxially mounted therein is the second transducer, or tweeter assembly. A horn shaped base support is mounted on the first transducer diaphragm, a voice coil former, or the dust cap which is generally employed with singular mechanizations of the dynamic radiator type transducers. In this arrangement, House suggests more than one type of orientation of the tweeter assembly with respect to the woofer. Significantly different from the previously mentioned prior art is the utilization by House of a piezo-electric transducer for driving the tweeter assembly. Later, in this disclosure references will be made to the general art disclosed by House; and, the piezo-electric tweeter driver shall be referred to more casually as "bi-morph" element. The House art, clearly relevant art at this late date, will be discussed in greater detail and in contrast to the techniques embodied by the instant inventor in realizing this improved, dynamic, bi-morph speaker.

Since the piezo-electric bi-morph element comprises a prominent part of the instant invention, a few words descriptive of its structure are in order. By definition, the driving element of the tweeter loud speaker is known colloquially as a "bi-morph", i.e., a bi-layer, amorphic ceramic element. The bi-morph wafer is composed, essentially, of two ceramic plates in the form of discs, with a voltage conductor (plane) sandwiched therebetween. When a driving electromotive force is applied to both of the ceramic plates and at the conducting voltage plane, piezo-electric effect causes flexure of the element in a direction normal to the plane of the element plates. The apex of the tweeter diaphragm cone is affixed proximate the center (and maximum flexure point) of the bi-morph wafer. Thus, the diaphragm of the tweeter translates the dynamics of the bi-morph element radially outward from its apex towards its largest or major perimetral margin. Conventionally (in the current art), the larger perimetral margin of the tweeter, or any mid-range speaker, is joined to the diaphragm of another speaker by some compliant material (compliance).

The instant inventor believes that because Olson and Preston did not have the advantage of the bi-morph element, they were not impelled to greater innovation in the coaxial mounting scheme that they pioneered. Because House was concerned with the structural dynamics of plural tweeters or mid-range speakers, he strayed somewhat from the pure coaxial mounting scheme and thus failed to give greater definition to an allusion of mounting the bi-morph element on (to) the woofer voice coil former.

The final piece of relevant art to be discussed is Japanese Application No. 57-122303, laid open 59-12700(A), issued to Ishikawa for a Composite Type Speaker. It was Ishikawa's purpose to obtain a composite type speaker of low cost and high efficiency by providing a piezo element, constituting a tweeter, and position it at a prolonged part of a woofer voice coil former. Ishikawa allowed the bi-morph element to merely touch the rim of a voice coil former extension while coupling the edge or rim of the element to the woofer cone via a paper extension which served as a (form of) cone for the tweeter. Illustrations in the Ishikawa disclosure, notably FIGS. 5 and 7, clearly indicate that the piezo element was not rigidly or fixedly secured to the voice coil former, nor any portion thereof. Thus, Ishikawa speaks of "coupling" rather than fixedly attaching (or securing) the piezo element to the voice coil former. In contrast, it shall be seen hereinafter that the instant inventor expressly attaches at least a portion of the piezo element margin (or periphery) to a dynamic part of the woofer. Where Ishikawa attempts to show that the posturing of the piezo element so that it touches the rim of the former extension, and suffers no ill effect thereby, the instant inventor contrarily secures it thereto and literally invites, rather than seeks to avoid, concurrent movement of both piezo element and woofer parts.

The instant inventor, wishing to develop a more highly efficient and higher fidelity coaxial (general, but not insistent) arrangement was inspired to perform a wide variety of experiments with placement and attachments of the bi-morph driven tweeter. The instant improvement is the result of his efforts.

Hereinafter the instant invention will be briefly disclosed, and in the following Detailed Description of the Preferred Embodiment, a comparison to the prior art of House and (later) Ishikawa shall be made; and, the benefits and improvements of the instant invention shall be clearly discussed and detailed.

SUMMARY

The present invention is a coaxial loud speaker system comprising essentially a woofer and tweeter loud speaker pair in which the dynamic radiator driver, the woofer, and the piezo-electric bi-morph driver of the tweeter assembly are coaxially arranged so that the tweeter bi-morph (planar wafer) driving element is attached to dynamic (moving) parts of the woofer such as the dust cap, diaphragm or the woofer voice coil former, in such a way that the motion of the bi-morph driving element is limited to flexure in a direction normal to the plane of the bi-morph disc/wafer element. The flexure direction of the bi-morph driving element is coextensive with the longitudinal axis passing through the voice coil former. Further to the present invention, the preferred embodiment contemplates fixation of the tweeter assembly to the woofer voice coil former and other dynamic parts; and such combination clearly contemplates any means of tweeter attachment, such as adhesive, cohesive, by silicone, etc.. Further to the tweeter, the apex of the diaphragm cone is somewhat flattened and mounted centrally to the bi-morph top surface or forward disc so that only the bi-morph wafer will bend (flex) during excitation and any vibrations will be propagated outward of the center through the tweeter diaphragm with complete uniformity. Compliances used to affix one element of the system to another comprise any compliant material known to those of skill in the industry and having a determinable (mechanical) compliance. Such a compliant member, an annular element having an internal partially or fully circumferential groove, is used often to mount the bi-morph disc or wafer pair to, on, or inside the woofer voice coil former. The latter transversely partitions the cylindrical former. In such a mounting, a similar, but more flexible compliance is also used to join the outer (major) perimetral margin of the tweeter to the end margin of the woofer voice coil former or on a minor circle proximate the apex margin of the woofer diaphragm. In this manner, the instant inventor realizes the mounting of the tweeter coaxial to the woofer so that the diaphragm of the former is clearly behind the major portions of the woofer diaphragm and, in effect, practically the entire tweeter assembly is mounted within the woofer voice coil former. Alternately, and as stated previously, a portion of the bi-morph wafer is fixed compliantly outside the former to any (operationally) moving or dynamic portion of the woofer assembly. Ishikawa shows a cone-like mounting of a wafer to the woofer diaphragm or cone, but this inventor has achieved remarkable and unexpected results fixing the wafer margin (partly or wholly) to other, non-diaphragmatic parts such as the dust cap, the former (forward) extension and directly to the woofer cone. The latter avoids the short, non-compliant "touching" of Ishikawa and achieves excellent results. Finally, in keeping with the alternate mounting of the bi-morph element, the instant inventor fixes (with or without compliant material) the element by at least a portion of its periphery to a cylinder or cone segment (hereinafter, a "frame") so as to allow subsequent mounting of the segment to the former, former rim or any moving part. Such are readily seen to be manufacturing expedients as well as successful working embodiments.

BRIEF DESCRIPTION OF THE DRAWINGS

Of the drawings:

FIGS. 7A (I-III) through 7C (I-III) are schematic representations of several tweeter driving element—woofer voice coil arrangements;

DETAILED DESCRIPTION OF THE PREFERRED EMBODIMENT

Figures 1A, 1B:
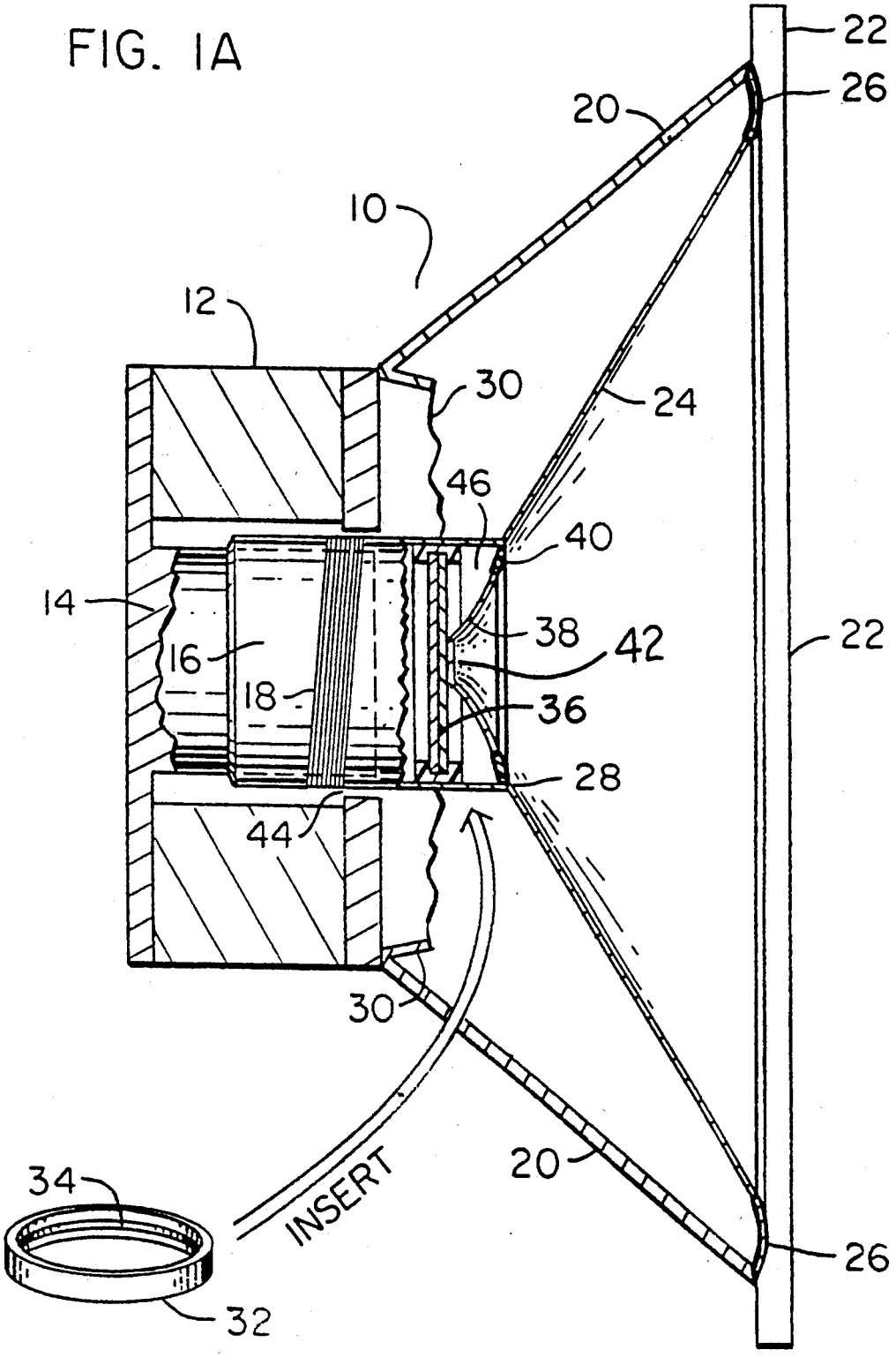
FIG. 1A is a cross-sectional side elevation of a multi-driver speaker combination of the instant invention.
FIG. 1B is an isometric detail of a tweeter mounting compliance of the present invention.

As pointed out in the Summary, the present invention comprises two significant improvements over the prior art. During this Detailed Description of the Preferred Embodiment, the innovative aspects of the instant invention shall be contrasted with the most prominent examples of the relevant prior art and, subsequent to the complete disclosure of the invention, a statement shall be given expounding the benefits derived from each of the discrete differences between the instant invention and all of the prior art, the aggregate realization of the differences constituting the totality of invention herein disclosed and subsequently claimed.

Referring particularly to FIG. 1, a cross-sectional, side elevation of the instant invention 10, there are clearly depicted the salient elements of an electro-magnetic, dynamic radiator loud speaker comprising: annular permanent magnet 12 with projecting central pole piece 14; low frequency (woofer) voice coil former 16; woofer voice coil 18; speaker assembly support frame 20; baffle-mount 22, to which the speaker assembly support frame is affixed; woofer conical diaphragm 24; annular compliance 26, for mounting the larger perimetral margin of the diaphragm 24 to the speaker assembly support frame 20; and the woofer voice coil former-diaphragm juncture 28, generally acquired through ordinary adhesive joining methods. Additional support is afforded the woofer diaphragm 24 by the use of a diaphragm (cone) support 30 between an annular perimeter of the speaker assembly support frame 20 and the woofer voice coil former 16. This additional support also aids in maintaining air gap 44 which allows, in addition to the electrically induced vibration, a motion of the woofer voice coil former in the direction normal to the plane passing through the permanent magnet annulus 12 and, as shall hereinafter be seen, normal to the plane of the bi-morph element 36.

Figure 3B:
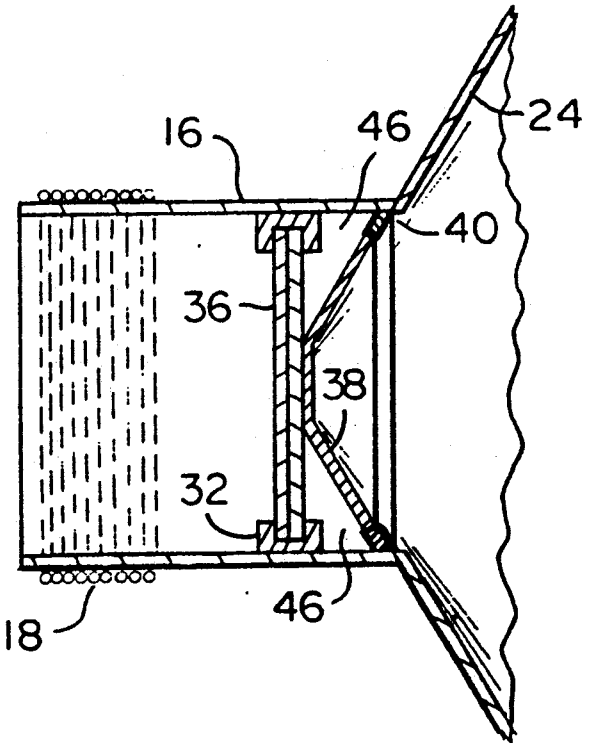
FIGS. 3A and 3B is a double, side and front, elevation and orthographic schematic of the present invention.
Figure 3A:
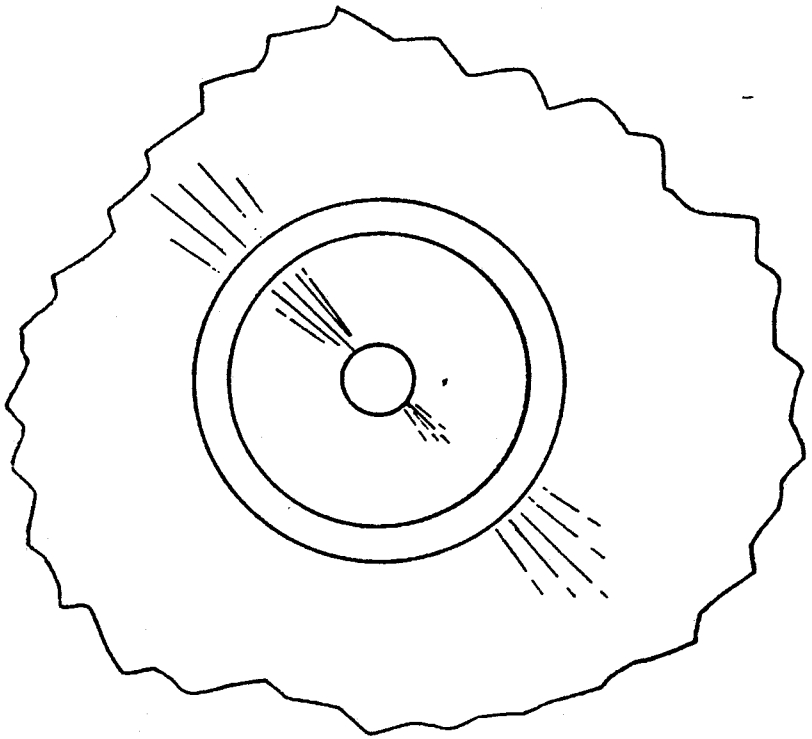

Referring now more specifically to FIGS. 1A–1B in conjunction with FIG. 3, the annular compliance 32 which is used to mount the bi-morph element 36 is shown in isometric detail and projected to its residence within the woofer voice coil former 16, as indicated by the INSERT arrow of FIG. 1B. Annular groove 34, circumferentially interior of the mounting ring 32, provides the capturing framework for the bi-morph element 36. A tweeter conical diaphragm 38 is mounted centrally 42 to the bi-morph element 36. The reader will note that the tweeter cone bi-morph mount 42 is affixed to the bi-morph element 36 at the center of the entire unit, on the axis previously described as the normal (perpendicular) to the planes of both the permanent magnet 12 and the bi-morph element 36. At this point, the bi-morph element realizes its maximum flexure along the previously defined normal. The reader should notice that the bi-morph element 36 is positioned well behind the frontal margin of the woofer voice coil former 16 in this embodiment. Once fixed in this position, the tweeter cone 38 is secured to the front or forward margin (rim) of the voice coil former by annular compliance 40. Thus, two innovations by the instant inventor are realized at this point of construction: full emplacement of the bi-morph element 36 within the woofer voice coil former 16; and, physical mounting of the tweeter cone 38 within the voice coil former and behind the low frequency conical diaphragm 24 so as to practically form a continuous conical diaphragm radiating from the center of the bi-morph element 36 to the annular compliance 26, or some suitable juncture of the woofer diaphragm 24 with the speaker assembly support frame 20. It is this unique structure and diaphramatic continuum that gives rise to the improved audio propagation characteristics that shall be described in the discussion of FIGS. 5A, 5B, 6A and 6B.

Figure 2:
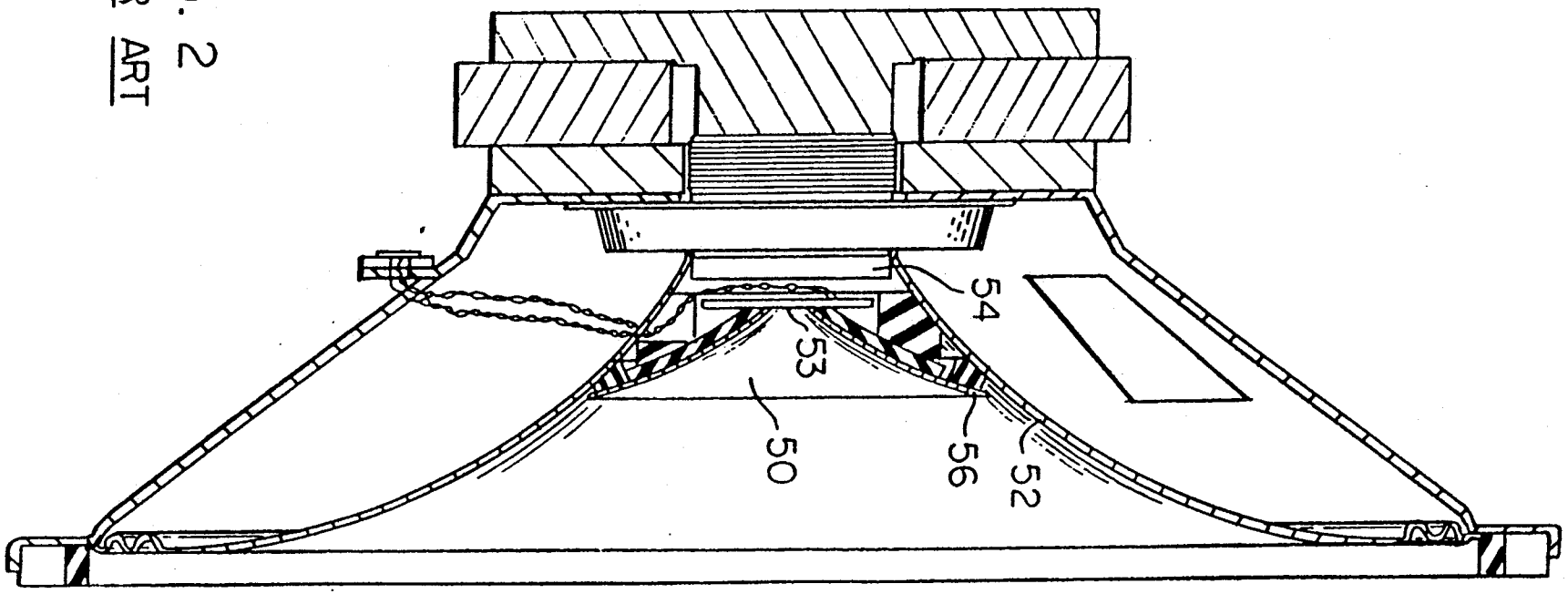
FIG. 2 PRIOR ART
FIG. 2 is a cross-sectional side elevation of an earlier multi-driver loudspeaker system.

A most relevant piece of prior art discussed was clearly that of U.S. Pat. No. 4,554,414. A replication of FIG. 1 from '414 is had at FIG. 2 of the instant disclosure and labeled, accordingly, PRIOR ART. Referring to FIG. 2, there is disclosed an assembly which, in general, closely resembles a significant part of the FIG. 1 illustration. Nonetheless, there are significantly different aspects in respect of the prior art illustration: its tweeter diaphragm 50 is positioned inside of the woofer conical diaphragm 52 so that it may be said to be clearly mounted in front of the woofer diaphragm; the bi-morph element 53 is therefore also mounted forward of and over the woofer diaphragm; the voice coil former 54 is void of any tweeter elements; and the compliant annular mounting structure 56 of the tweeter clearly places it on the woofer diaphragm 52 surface.

Figure 4B:
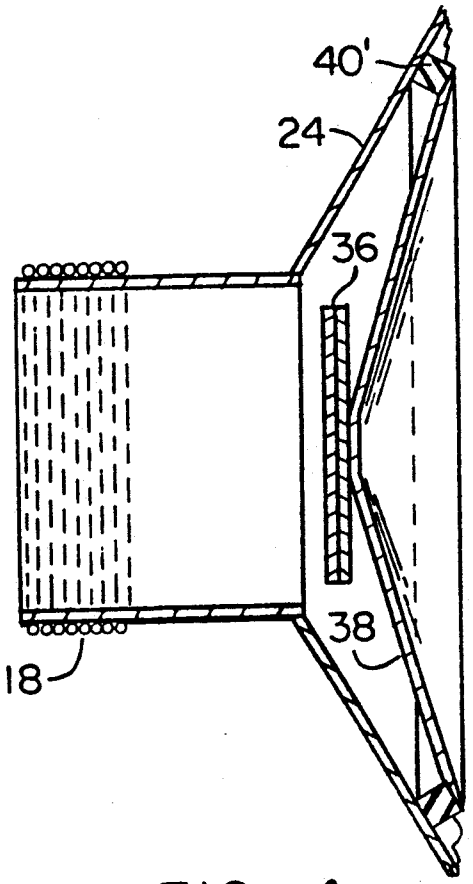
FIG. 4B PRIOR ART
FIGS. 4A and 4B is an orthographic schematic of the device of FIG. 2, after the style of FIG. 3.
Figure 4A:
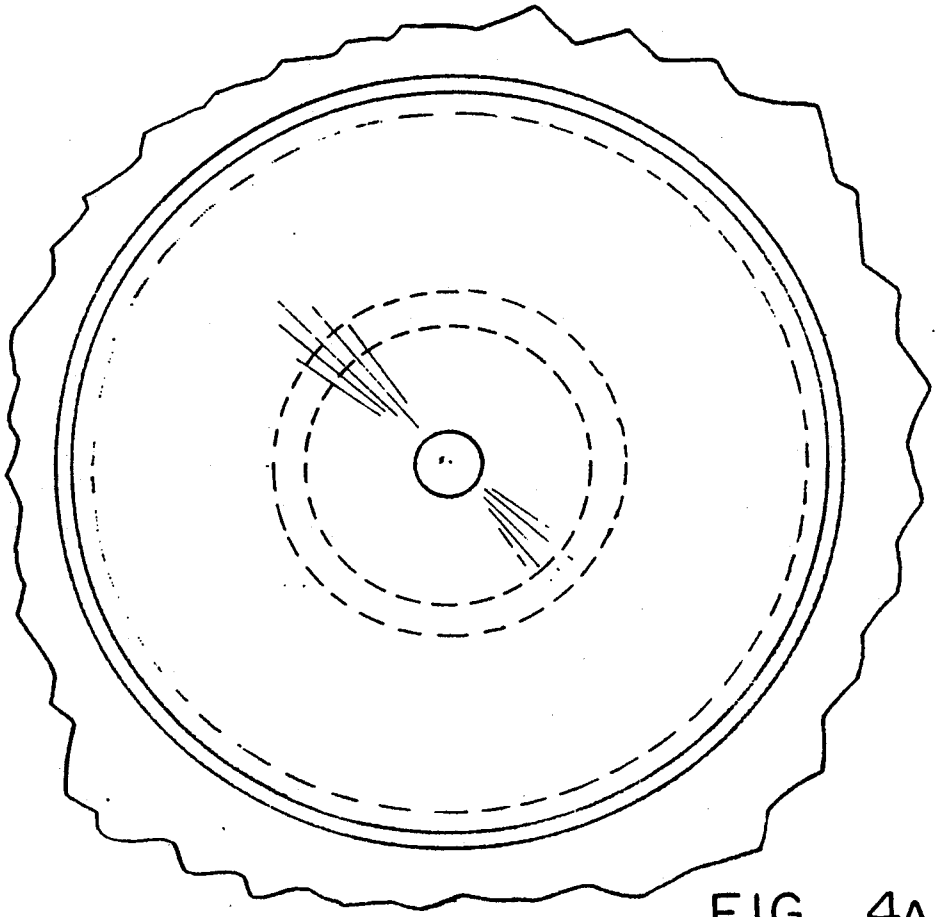
FIG. 4A PRIOR ART

In order to more clearly contrast the standard elements of the prior art with the novel aspects of the instant invention, the following disclosure will have concurrent reference to FIG. 3 and FIG. 4. Where elements of the assemblies are identical, or strongly similar, the same numerical reference shall be used and shall correspond to the nomenclature used in FIG. 1; where subtle differences exist, the prime (') notation shall be employed and, where significant differences or novelties exist, there shall obviously be no corresponding nomenclature in the prior art, as depicted in FIG. 4.

As seen in FIG. 3, the salient elements comprise: the high frequency or tweeter bi-morph driving element 36; the tweeter conical diaphragm 38; the unique bi-morph element attachment means 32 within the woofer voice coil former 16; the significantly different tweeter cone outer edge attachment means 40, wherein the tweeter cone is set behind the frontal surface of the woofer diaphragm 24; the woofer voice coil former and diaphragm, 16 and 24; the woofer voice coil 18; and, completely absent from the prior art, the sealed cavity 46 between the bi-morph element 36 and the tweeter conical diaphragm 38. In the prior art of FIG. 4, only five of the previously mentioned elements of FIG. 3 are identical, elements 16, 18, 24, 36 and 38. The prior art, not only that of FIG. 4, but as a whole, lacks: element 32, the bi-morph attachment means and its unique position within, or attached securely to, the voice coil former 16; and the unique tweeter cone (outer edge) compliant attachment means 40. It is depicted as 40' of the prior art in FIG. 4 because, in all prior art, the conical diaphragm of the tweeter is mounted by its perimetral margin to the woofer diaphragm 40' (see the FIG. 4 prior art depiction). Because of this distinction in prior art tweeter mounting, not only are audio distortions created, but it is impossible to acquire a sealed cavity 46 behind the tweeter diaphragm and in front of the bi-morph driving element 36. A sealed cavity (volumetric) may be engineered so as to acquire a resonant cavity that is "tunable". By such tunability, certain desirable audio characteristics, particularly in the high frequency ranges, are achieved with the present invention. This design also allows the use of differing, lighter materials for making the tweeter diaphragm, thus allowing a closer approach to the ideal speaker diaphragmatic mass of zero. Because the instant inventor has developed an unique placement of the bi-morph driving element within the voice coil former (air core) and attaches the tweeter diaphragm margin to the voice coil former rim, he has acquired an apparatus giving an increased phase coherence to the audio output of this loud speaker system and, although not approaching the ideal phase coherence of infinity, has achieved significant improvement over the prior art. Until now, all nesting of tweeters and intermediate range speakers within one another has been the norm and, in order to do so, a significant amount of audio phase distortion has been suffered. That disadvantage has been overcome by the instant invention.

Before departing from the discussion of FIGS. 3 and 4, it is notable that a minor disadvantage of the prior art has been overcome, the tenuous suspension of the bi-morph driving element, as seen in FIG. 4. There it will be noted that the bi-morph element 36 appears to be projected to the left, just in front of the woofer voice coil former 16. Depending upon the orientation of the speaker system, this suspension of the bi-morph element could be said to be either cantilevered or pendulous, or somewhere in between. Ordinary reason tells us that over a period of time, or after a series of undesired vibrations or movements, there will be visible distortion of the tweeter cone caused by the torque due to the (mass of the) suspended element. Although this diaphragmatic distortion may not be measurably significant, it will nonetheless be suffered as additional audio distortion in the higher frequency ranges. Clearly, the unique attachment means of the instant invention obviates such distortional damage to the tweeter diaphragm.

Figure 6A:
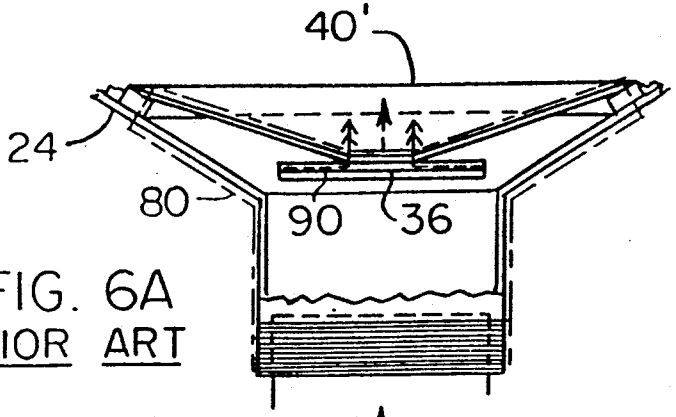
FIG. 6A PRIOR ART
FIGS. 6A and 6B are repetitions of FIGS. 5A and 5B, respectively, relating to the device of FIGS. 2 and 4.
Figure 6B:
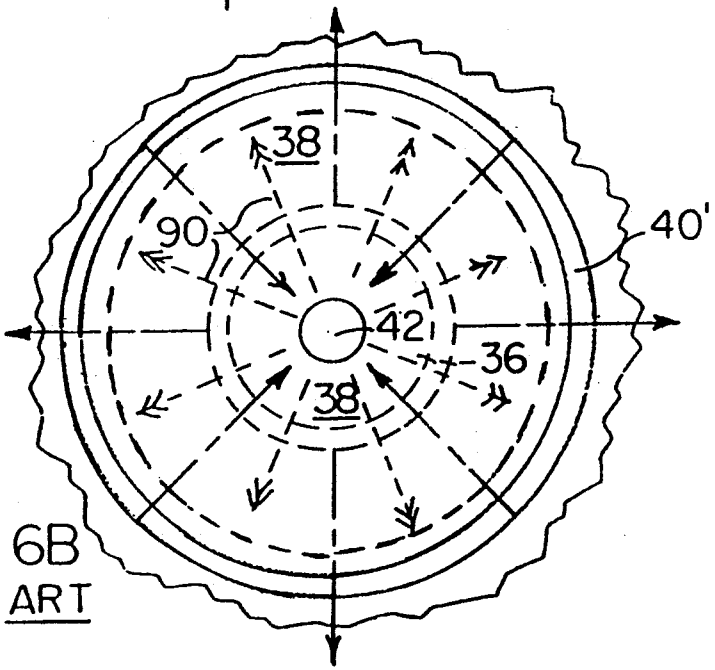
FIG. 6B PRIOR ART
Figure 5A:
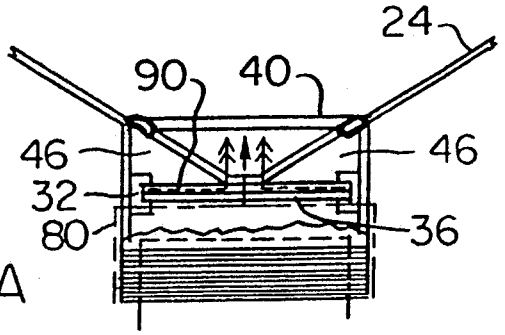
FIGS. 5A and 5B are orthographic schematic illustrations of the present invention depicting sound propagation routes.
Figure 5B:
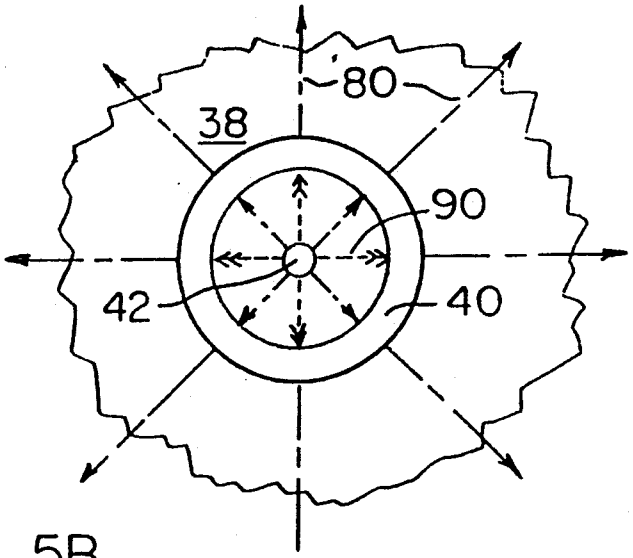

To more clearly describe the distinctive audio propagation benefits that are acquired by the instant invention, FIGS. 5A through 6B, representing both the instant invention and the prior art tweeter mountings are shown in orthographic, schematic illustration. The direction of high frequency (HF) propagation is denoted by short dashed lines 90 only and the direction of low frequency (LF) propagation is shown by the heavier, long and short dashed lines 80. Referring particularly to FIG. 5A, the instant invention, with its salient elements, including the bi-morph element 36 mounting means 32 and the tweeter cone outer edge attachment means 40, develops a propagation flow path of low frequency originating at the woofer voice coil and in the direction normal to the plane passing through the bi-morph element 36. The LF propagation 80 suffers nearly zero delay as it passes thorough the bi-morph element radially outward of the tweeter cone and radially outward of the woofer cone. FIG. 5B discloses the concurrent propagation of both high frequencies 90 and low frequencies 80 as they clearly appear in phase. In contrast, similar propagations of the high and low frequencies in the prior art, as disclosed in FIGS. 6A and 6B, suffer considerable audio impairment in the crossover frequency ranges. FIG. 6B illustrates how, at the surface of the tweeter, the vibrations of the LF propagation 80 regress (down) the face of the woofer to the tweeter, through the compliant juncture 40', and towards the tweeter base mount 42. Because in the prior art most (cones of) tweeters are mounted on the surfaces of the woofer diaphragm (or intermediate range speaker diaphragms), there will always be some vibrational wave propagated from the point of juncture, in this case at the compliant mounting 40'. As seen in FIG. 6B, such (reverse) propagation will have an adverse effect on the quality of audio results because of the antiphased, interfering relationship projected by the various tweeter and intermediate range speakers onto the woofer pattern at crossover regimes.

Having described in detail the elements of the instant invention, and before disclosing the latest variations developed by the instant inventor, in order to exploit the differences between the present invention and the prior art, it is appropriate to amplify somewhat on such discrete differences and relate the novel benefits obtained by practice of the instant invention.

Consider first a difference between the instant invention and the art disclosed in an earlier House patent ('981) where, in the instant, the driver element of the (bi-morph) tweeter is driven directly by a connecting element (bi-morph attachment means 32) other than the woofer diaphragm (as in House) and attached thereby to the voice coil former of the woofer. The benefits derived through the realization of this innovation are improved phase response, improved amplitude response, synchronization of the sound wave propagation direction in both woofer and tweeter, removal of support stresses from the tweeter diaphragm cone, improved support of the bi-morph driver element and suppression of unwanted resonances in the bi-morph assembly. Elaborating respectively, phase response is defined as the timing relationship of the various frequencies and transients as they reach the air in front of the speaker diaphragm. In the House design, the time difference between low frequencies from the woofer and the high frequencies from the tweeter is approximately one millisecond. This corresponds to about an eight cycle shift in an 8 KHZ signal. This large difference is easily perceived by persons having normal hearing and is described as a "smearing"of the sound. Such a deleterious effect makes it very difficult (or impossible) to hear each instrument in an orchestra as a separate sound source, one of the principal reasons for stereophonic apparata. However, because of the direct (securely fixed) coupling between the woofer voice coil former and the tweeter bi-morph edge in the present invention, the time difference between the signals is only about, or less than, 100 microseconds, which results in a much more accurate wave form in the case of multiple frequencies and transients (that are) typical of orchestral music. Thus, every instrument in a full orchestra is readily identifiable. Amplitude response is the relative size or intensity of the various frequencies and transients which are superimposed upon one another. In particular, frequencies in the crossover region (approx. 3-5,000 Hz) are improved through the design of the instant invention. In this frequency region, driving force is originating in the woofer and tweeter simultaneously, and excitation is had at the diaphragm surface (center of the tweeter diaphragm) with less than 100 microsecond delay of the woofer signal. This results in the two identical signals being added "in phase", which results in the proper amplitude. The audible effect is that instrumental sounds are reproduced with their original timbre or tonality. Thus, it becomes easier for the listener to distinguish the different types of say, horn instruments (i.e., french horn, trombone, etc.). Relative to synchronization of sound wave propagation direction in the woofer and tweeter, it should be understood that all sound energy originates in the center of the tweeter cone (or the tweeter diaphragm), the low and high frequencies both propagating radially outward along the surface of the cone. This results in improved "imaging" of the sound as a "point source"; and allows the listener to more accurately place the sound source in the spacial position "created" by the stereo effect. Relative to the relief of support stresses from the tweeter diaphragm cone, attachment of the bi-morph discs to the woofer voice coil former removes the burden of support from the tweeter cone and places it on the woofer voice coil former. The tweeter cone thus has only the function of transmittal of energy to the air and can therefore be made lighter, as previously mentioned. All other things being equal, the lighter the moving mass of the transducer, the better it is able to handle quickly changing inputs (high frequencies). This results in better high frequency response. Finally, relative to the improved support of the bi-morph driver element, suppression of unwanted resonances in the bi-morph is readily apparent. At high power levels, the bi-morph discs in the House designs will oscillate in the axial direction relative to the movement of woofer voice coil former. This results in an audible resonance (of that) frequency, and which is not present in the original (voltage) wave form. The design of the instant invention keeps the bi-morph discs in nearly exact coincidence with the woofer voice coil former, and thus eliminates such unwanted resonance. The audible effect is a cleaner sound. Also, it should be noted that the addition of the bi-morph disc holder (mount) gives the engineer more opportunities to control the resonances of the bi-morph discs themselves, which results in a smoother and less "peaked" frequency response in the high frequency region.

A second notable difference between the instant invention and the prior art is that of the tweeter cone outer edge support by an annular ring which is (compliant and) highly absorptive of vibrations in the crossover frequency region and which is not required to contribute significantly to tweeter cone structural support in the axial direction. The benefits are a reduction of interference between woofer and tweeter diaphragm cones, attainment of an annular ring of lower cost and mass giving less critical vibrational characteristics, and improved suppression of unwanted oscillatory modes of vibration in the tweeter cone, if any is used. As above, an amplification of the aforementioned benefits are hereinafter addressed. Removal of the support burden of the bi-morph discs from a cone allows the use of a very pliable (highly compliant) annular ring which supports a tweeter cone in the radial direction only. Since the sound waves from the woofer diaphragm are primarily transverse (a factor known to those of ordinary skill), they are nearly entirely absorbed by the annular ring. High frequencies are likewise absorbed as they travel along the tweeter diaphragm. This removes intermodulation distortion from the system, which is audible as an alternating high and low amplitude sound not present in the original wave form. The annular ring in the House and Ishikawa designs, like much of the prior art, has many functions to perform, including support of tweeter cone and assembly, transmittal of low frequency sounds from the woofer diaphragm, and partial transmission and absorption of sounds from the woofer in the crossover frequency region. It is extremely difficult to optimize all of these functions simultaneously; thus, in the instant invention, use of the annular mounting ring 32, which has only the functions of suppressing unwanted resonances in the tweeter cone, and of sealing the front of the tweeter cone (see FIG. 1 description-adhesive juncture 28) from the back of the tweeter cone (in a preferred embodiment), significantly decreases the number of functions that must be performed. The mount of the instant invention has no transmittal requirements between the woofer and tweeter diaphragms; this is a significant improvement and a departure from the prior art. Relative to the mass of the annular ring, that of the House and Ishikawa designs appear to be about two to three inches in diameter, and must be fairly rigid in order to support entire tweeter assemblies. This means that masses must be fairly high. The annular ring of the instant invention (when used) has a diameter of approximately one inch, and has practically no support requirement. Its mass would be a small fraction of the prior art designs. The audible result is a better high frequency response. Relative to the last benefit, at high power levels, all diaphragm cones are subject to "cone break-up". The instant design utilizes an annular ring which is optimized for support in the radial direction, and it is better able to control the cone break-up which occurs primarily in the radial direction. The resultant benefit in this case is a cleaner sound with lower distortion relative to the original wave form.

The third notable difference, that wherein the tweeter cone outer perimetral edge is mounted flush with the surface of the inner edge of the juncture between the woofer cone and the voice coil former (bimorph is mounted inside the former), provides rather extensive benefits, one of the most notable being less dissipation of woofer energy. In all of the House designs, the annular ring which supports the tweeter assembly is attached to the woofer diaphragm at some point between the woofer voice coil former and the woofer diaphragm outer edge. This means that the transverse wave in the woofer diaphragm will be partially absorbed by the annular ring. The instant invention design calls for the annular ring to be attached to the woofer voice coil former, which conducts energy as a longitudinal wave. Longitudinal waves are much more efficient transmitters of energy than transverse waves, in general. The audible result is the benefit of higher "bass" output for a given level of input voltage (i.e. higher efficiency). Another benefit (of the third difference recited above) is improved vibrational modes of the woofer cone. Since the instant design makes no, or only modest, attachment to the woofer diaphragm, there is no effect on the woofer diaphragm's conduction of the low frequency transverse waves, making it easier to engineer the woofer cone for optimal sound characteristics. The audible result of this improvement is therefore a cleaner bass sound without coloration from unwanted resonances. A major and yet another benefit is the lack of confined air space between the woofer cone and tweeter cones, thus reducing unwanted resonances. Prior art designs, including all of the House and the Ishikawa designs, have a partially confined air space in the area mentioned. This confined air space will have its own resonance(s) in the audible frequencies, and will be heard through the tweeter diaphragm cone. The instant invention does not have an air space in the area mentioned. Still another benefit is acquired: smaller or no tweeter diaphragms result in better high frequency dispersion and lower or no (diaphragm) mass. All other things being equal, the smaller the source of a sound, the more it acts as a point source, which has the maximum degree of dispersion of sound. Dispersion is measured as the amount of variation of the amplitude of a sound as the measuring device (the ear) is moved off-axis from the sound at a given distance. The ideal dispersion would be zero variation of the amplitude of the received sound through a wide angle from (off) the axis of the sound producing device (diaphragm center). The audible benefit in the instant invention is a larger field of sound in a listening area so that the sound does not vary significantly as one moves about the area. The audible benefit of a lower mass is that stated above relating to the removal of support stresses from the tweeter diaphragm cone. A fifth benefit to be derived is that the woofer cone can be made lighter. This means that, for a given woofer diameter, the upper frequency limit that it will reproduce is higher. The crossover region can therefore be moved to a higher frequency range The audible benefit here derives from the fact that the further away the crossover region is from the middle of the frequency range, the less sensitive the ear is to small unwanted sonic effects which are inevitable in any crossover region. It is well known that the human ear is most sensitive to sounds in the area of 200 to 2,000 Hz. A sixth benefit, and one which is readily apparent, is that the woofer cone has greater effective area. Since the diameter of the tweeter cone in the instant design is much less than that of the House or Ishikawa designs (about one inch maximum vs. several inches), the woofer cone is not covered significantly by any portion of the tweeter cone; indeed, the tweeter cone is behind or generally detached from the woofer cone. The audible benefit in this instance is a resultant greater bass sound output for a given input voltage. A seventh benefit, derived from the placement of the entire tweeter assembly inside the voice coil former, is that the producing entity is required to align only two separate structures: the bi-morph element within the voice coil former and the one or two diaphragms, the tweeter (if used) secured to the forward perimetral edge of the voice coil former; and the woofer according to ordinary attachment practice. Two remaining benefits of the tweeter cone outer perimetral edge mounting (at the woofer cone-voice coil former junction) provide clear advantages over the prior art. They are the fact that the angle between the woofer and tweeter cones can be increased to 180 degrees; and that the smaller tweeter diaphragm may be produced from materials having less mass and greater rigidity. In comparing the drawings, these advantages become evident. Since the tweeter diaphragm in the instant invention can have the same rate of flair (divergence) as the woofer cone, they constitute the same conical geometry (a continuum). The House design requires two different flair rates in order for the tweeter cone to fit on the woofer cone. Such is also evident from the other prior art disclosures beginning with Olson through Ishikawa, and clearly constitute a limiting factor in all of the prior art. The audible benefit to be gained in the instant invention is that of greater continuity of the sound wave in the air at the juncture between the tweeter cone and the woofer cone. This results in a cleaner sound and better dispersion characteristics, particularly as noted in contrasting FIGS. 5A and 5B with FIGS. 6A and 6B. The audible benefit of lower mass and greater rigidity in the tweeter loud speaker has already been discussed and should suffice for this statement of advantages.

A fourth notable difference, the sealability of the air space between the tweeter driver element and tweeter cone provides a major advantage, tunability of the volume of the enclosed air confined by the sealing in order to maximize the flatness of the tweeter frequency response. This was disclosed at length in U.S. Ser. No. 361,351, supra.

This continuation-in-part of U.S. Ser. No. 361,351 acquires and passes on the benefits of extensive work with the embodiments previously disclosed in FIGS. 7A(I-III) through 7C(I-III). Most notable is the realization that good sound quality, equivalent to the first results reported herein, are obtainable with compliant fixture of only a portion of the piezo bi-morph element 36 (shown in FIGS. 7A II and 7C II). Further, it has since been discovered, quite unexpectedly, that attachment to the woofer assembly need only be had at discrete, dynamic parts i.e., only portions which oscillate, vibrate, translate or otherwise move during loud speaker operation. As taught earlier therein, the bi-morph element need not be completely fixed (compliantly) about its entire periphery (see FIGS. 7) and, although the compliant fixture successfully eliminates any crossover problems, it need not always be of a compliant material. This realization led to the development of an alternate tweeter assembly method and article, the replacement of the bi-morph element 36 in an anchor 33 (which is much akin the ring 32) with fixture thereby to a frame of desired shape. The instant inventor has chosen to use a cylindrical section 102 and/or a conical section 104 as shown in FIGS. 8B, 9C and 9D, to serve as frames for anchoring bi-morph elements.

Figure 8B:
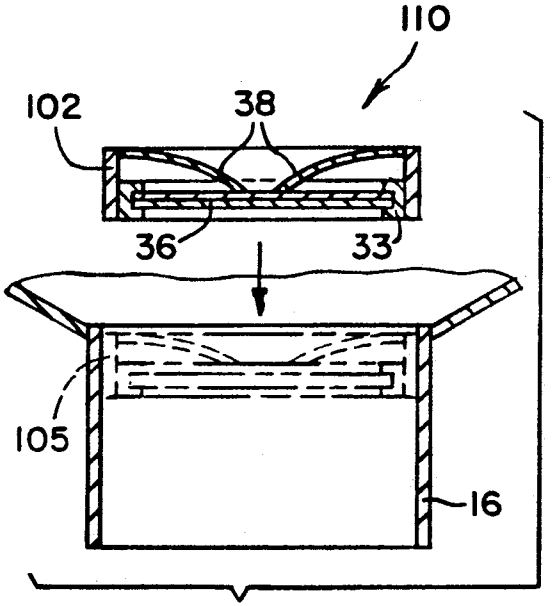
FIGS. 8A and 8B illustrate, in schematic, preferred and alternate installations of a bi-morph wafer in a voice coil former, respectively.
Figure 8A:
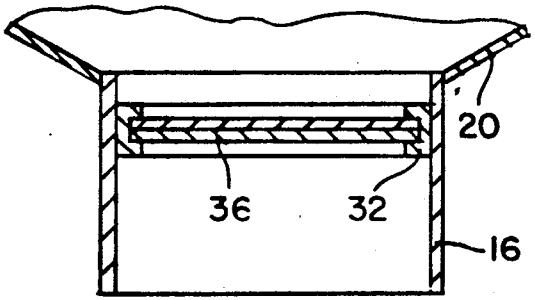

Referring specifically to the FIGS. 8A-9D complex, the reader may note first, in FIG. 8A, the originally presented invention 10 which includes the salient parts of former 16, bi-morph element 36, compliance (ring) 32 and woofer cone 20.

Next, FIG. 8B depicts an improvement 110 of the instant continuing application. Here, the reader may readily discern that the piezo bi-morph 36 is fitted into a cylindrical section 102 by adhering it to the interior surface thereof by use of an adhesive 33 which may or may not be a compliant material. With but a slight difference in FIG. 8A (note the absence of tweeter cone 38 which is not depicted in FIG. 8A), similar morphology is obtained by inserting the cylindrical frame 102 into the driver voice coil former 16 proximate a rim thereof, denoted by dashed illustration labeled 105. It may be seen that the frame 102 is pressed into the voice coil former 16 in the direction of the heavy arrow. The instant inventor has obtained considerable success with this technique of mounting the bi-morph element 36 in various configurations inside, on, and outside of the voice coil former 16 or any moving part. For example, depending upon the size of the bi-morph element, or in some cases simply ignoring the size of the element and effecting configurations shown in a cylindrical or conical section such as those of FIGS. 7A II and 7C II, the frame may be made to fit inside the voice coil former 16, proximate the rim of an extension of the former or simply slip over the outside of such an extension. Since a great deal of the success realized with these various designs is empirical, those artisans at liberty to practice the invention will discover that several means and modes of attachment of the bi-morph element of the instant invention will be successful provided the basic inventive concept is maintained throughout, that is, it is imperative that the bi-morph wafer be captured fixedly at or about the edge thereof (either partially or wholly) and be attached by its capturing means, whether compliant or not, directly to an operationally moving part of a lower frequency driver assembly. As pointed out in the Prior Art Discussion, the basic concept of fixedly securing the edge of a piezo bi-morph wafer to the dynamic parts of another driver, whether compliantly fixed or not, is shown nowhere in the art.

Figure 9A:
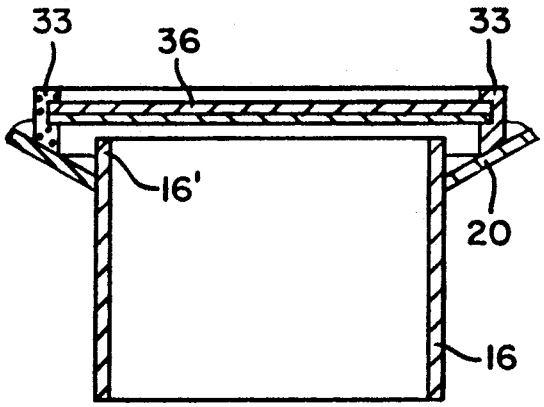
FIG. 9A schematically illustrates a bi-morph wafer mounting to a woofer cone.
Figure 9C:
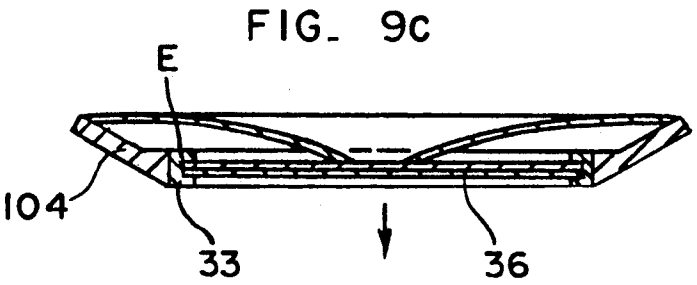
FIG. 9C is a tweeter assembly cross section.
Figure 9D:
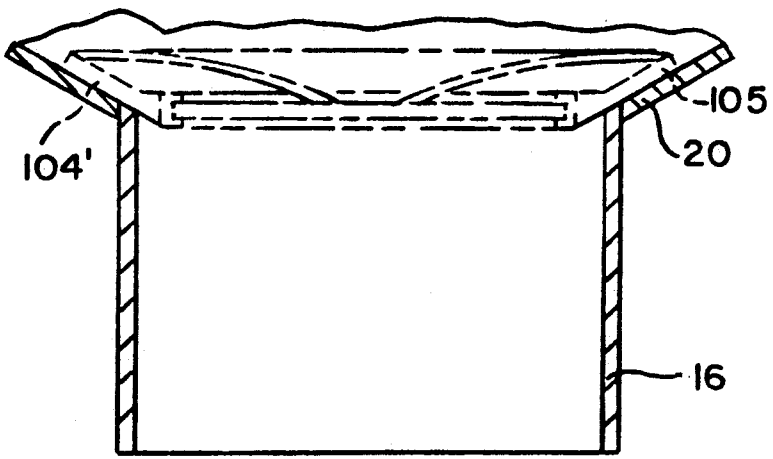
FIG. 9D is a voice coil former posited below the FIG. 9C device to illustrate the device's fixation thereto.
Figure 9B:
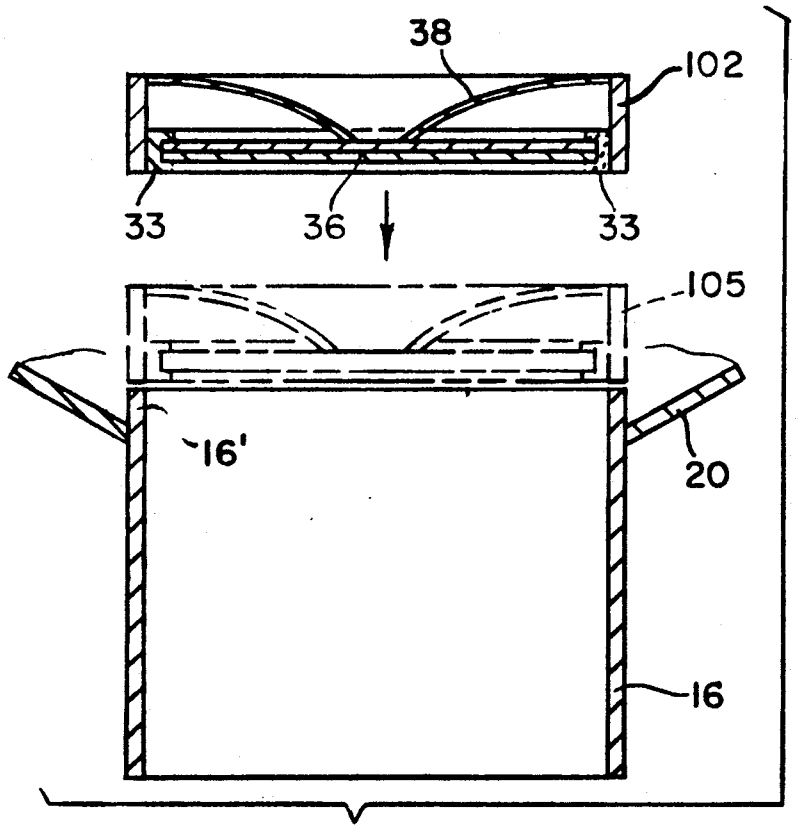
FIG. 9B illustrates a bi-morph wafer mounting corollary to FIG. 8B on a voice coil former with extension.

In keeping with the previously discussed concept, FIG. 9A depicts the instant inventor's improvement over the prior art that was depicted in FIGS. 4 and 6A, namely that of fixing the bi-morph wafer 36 on a woofer cone 20 by fixedly securing it thereto through compliant ring 32. FIG. 9B illustrates the extrapolation of the FIG. 8B concept using the bi-morph element 36 of the instant invention captured partially or wholly at/on its rim within a cylindrical section 102. The section is then pressed onto, over or into the voice coil former extension 16'. As illustrated, the positioning of the bi-morph element may be had on, in, or proximate any of the woofer driver parts such as the cone 20, dust cap (not shown) or on/inside/outside the driver voice coil former 16 or former extension 16'.

FIG. 9C illustrates the conical analog 104 of the FIG. 9B tweeter assembly. Here, as in FIG. 9B, the bi-morph element 36 is secured about its margin/edge E, or at least a portion thereof, to the conical frame 104. Thereafter, as depicted by the heavy arrow, the FIG. 9C article is set onto and fixed, by suitable adhesive, to (an inner) portion 105 of the cone 20-voice coil former 16 assembly. This rigidifies a portion of the woofer cone and creates a pseudo-extension of the former 16 without sacrificing any functionality in either woofer or tweeter assembly.

Having completed extensive testing of the herein revealed designs, a summarization of the empirical observations on the invention is in order. In the instant invention, the piezo driver tweeter assembly needs no cone (FIG. 8A). It is possible, and oftentimes advisable, to align the planar driving element 36 off-axis with the woofer voice coil. Many differing tweeter and diaphragm shapes and configurations are obtainable as pointed out in the (Figures) 7A I-7C III complex. FIG. 9B proposes that it is often advantageous to build the assembly with the high frequency transducer postured entirely in front of the lower frequency diaphragm. Finally, as FIGS. 8B, 9B, 9C and 9D adequately illustrate, intermediate mounting means (frameworks) may be inserted between and joining the planar driving element 36 and any of the woofer moving parts.

The preceding detailed discussion, in conjunction with the illustrations herein, serve to show that applying the basic concept espoused by the instant inventor is an artform of practically unlimited range. These teachings are commended particularly to those in the audio sound system field who constantly pursue innovations in the art for the purposes of providing high quality instrumentation at reasonable cost. The instant invention will provide considerable response to these industry needs.

What is claimed is:

1. A multi-driver loudspeaker system comprising:

a first driver including a voice coil former;

a second driver having a planar driving element, said planar driving element having first and second opposing planar sides and an edge portion joining said first and second planar sides; and means for fixedly attaching said edge portion of said planar driving element to said voice coil former.

2. The system according to claim 1 wherein the planar driving element is a piezo bi-morph wafer.

3. The system according to claim 1 wherein said means for fixedly attaching said edge portion of said planar driving element to said voice coil former further includes:

a frame for receiving said planar driving element;

means for fixedly attaching the edge portion of said planar driving element to said frame; and means for fixedly attaching said frame to said voice coil former.

4. The system according to claim 3 wherein said frame is fixedly attached to an internal section of said voice coil former.

5. The system according to claim 3 wherein said frame is fixedly attached to an external section of said voice coil former.

6. The system according to claim 3 wherein said voice coil former further includes a voice coil former extension and wherein said frame is fixedly attached to a section of said extension.

7. The system according to claim 6 wherein said frame is fixedly attached to an internal section of said voice coil former extension.

8. The system according to claim 6 wherein said frame is fixedly attached to an external section of said voice coil former extension.

9. The system according to claim 3 wherein the planar driving element is a piezo bi-morph wafer.

* * * * *